United States Patent [19]

Moffitt et al.

[11] Patent Number: 4,555,882

[45] Date of Patent: Dec. 3, 1985

[54] MOISTURE GUARD FOR WINDOW FRAMES, DOOR JAMBS AND THE LIKE

[76] Inventors: Gregory A. Moffitt, 24993 Skyland Rd.; Glenn E. Brown, 24040 Summit Rd., both of Los Gatos, Calif. 95030

[21] Appl. No.: 543,607

[22] Filed: Oct. 20, 1983

[51] Int. Cl.[4] ..... E06B 1/04

[52] U.S. Cl. ..... 52/204; 52/97; 52/209

[58] Field of Search ..... 52/728, 97, 724, 725, 52/727, 204, 209, 309.8, 309.9, 309.14, 208, 211, 212

[56] References Cited

U.S. PATENT DOCUMENTS

| | | | |
|---|---|---|---|
| 139,641 | 6/1873 | Widmann | 52/97 |
| 819,041 | 5/1906 | Corbett | 52/97 |
| 993,861 | 5/1911 | McRonald | 52/97 |
| 1,202,267 | 10/1916 | Campfield | 52/97 |
| 1,677,130 | 2/1927 | Cherry | 52/209 |
| 2,482,170 | 9/1949 | Gunnison | 189/75 |
| 2,648,107 | 8/1953 | Bates | 20/70 |
| 2,697,932 | 12/1954 | Goodwin | 52/97 |
| 2,928,274 | 3/1960 | Berg | 72/127 |
| 3,527,012 | 9/1970 | Hemminger | 52/665 |

FOREIGN PATENT DOCUMENTS

| | | | |
|---|---|---|---|
| 799964 | 8/1958 | United Kingdom | 52/209 |

*Primary Examiner*—Donald G. Kelly
*Assistant Examiner*—Creighton H. Smith
*Attorney, Agent, or Firm*—Jack M. Wiseman

[57] ABSTRACT

A moisture guard for inhibiting water damage to the interior of a home or building caused by moisture, leaks, rain, snow or the like accumulating at a door frame, window frame or the like. The moisture guard comprises a metallic facing fixed to a plastic molding, such as ABS plastic. The sill of a window frame or the sill of a door frame is seated on the metallic facing. The moisture guard has a z-shaped cross-sectional area. An integrally formed upstanding rear flange is at the rear edge of the base and an integrally formed depending front flange is at the forward edge of the base. At an end of the base is formed an end flange with an upstanding vertical wall and with a vertical side wall. The height of the vertical side wall is coextensive with the height of the upstanding end wall and the vertical side wall extends to the depth of the depending front flange.

14 Claims, 4 Drawing Figures

MOISTURE GUARD FOR WINDOW FRAMES, DOOR JAMBS AND THE LIKE

BACKGROUND OF THE INVENTION

The present invention relates in general to devices for inhibiting water damage to the interior of homes and buildings, and more particularly to a moisture guard for a door frame, window frame or the like on which a sill is seated to inhibit water damage to the interior of a home or building.

The patent to Corbett, U.S. Pat. No. 819,041, issued on May 1, 1906, for Window Sill, discloses a metallic window sill on which rests a window frame. The metallic window sill comprises a horizontal bed which rests on the top of a wall and a depending flange which engages the wall for holding the sill in position. An integrally formed inclined section for the horizontal bed serves as a water shed or wash. Integrally formed with the inclined section and the depending flange is a depending end wall.

In the patent to Berg, U.S. Pat. No. 2,928,274, issued on Mar. 15, 1980, for Method Of And Means For Installing A Counterflashing In A Wall, there is disclosed a counterflashing to prevent seepage of water along walls into the space below roofing material. The counterflashing is formed of a sheet of metal and has a horizontal base with an upwardly turned flange along its rear edge and a downwardly turned flange along its front edge.

In the patent to Bates, Jr., U.S. Pat. No. 2,648,107, issued on Aug. 11, 1953, for Drip Deflector, there is disclosed a drip deflector that is attached to a window sill to deflect rainwater away from a building wall below a window sill. The drip deflector is made of galvanized iron or aluminum. It comprises a downwardly slanting flange at the front edge thereof and confronting upstanding end walls.

SUMMARY OF THE INVENTION

A moisture guard for a window frame, door frame or the like comprising a base with an integrally formed upstanding flange along the rear edge of the base, an integrally formed depending flange along the front edge of the base, and an integrally formed end flange with an upstanding wall along an end edge of the base and a vertical side wall joining the upstanding wall and the depending flange.

The moisture guard of the present invention is disposed below a sill of a window frame, door frame or the like to inhibit water damage to the interior of a home or a building caused by moisture leaks, rain, snow or the like accumulating at door frames, window frames or the like.

A feature of the present invention is that the moisture guard, in the preferred embodiment, except for a metallic facing, is made of molded plastic. Another feature of the present invention is the metallic facing, preferably of aluminum, is secured to the base of the moisture guard to provide a level support surface on which is installed the sill of a door frame, window frame or the like for improved durability of the door or window installation.

Another feature of the moisture guard of the present invention is the end wall, which embraces an upright member of a window frame, door frame or the like.

The moisture guard of the present invention may be formed with an end wall at each end thereof and with the metallic facing extending from end wall to end wall. In the alternative, two moisture guards of the present invention may be employed. One moisture guard is provided with an end wall at one end thereof and the other moisture guard is provided with an end wall at one end thereof. The end walls of the moisture guards are at the extreme ends thereof so that the placement of the moisture guards in overlapping end-wise relation or in end abutting relation locates the end walls at the opposite ends of the moisture guards.

DETAILED DESCRIPTION OF THE PREFERRED EMBODIMENT

Figure 1:
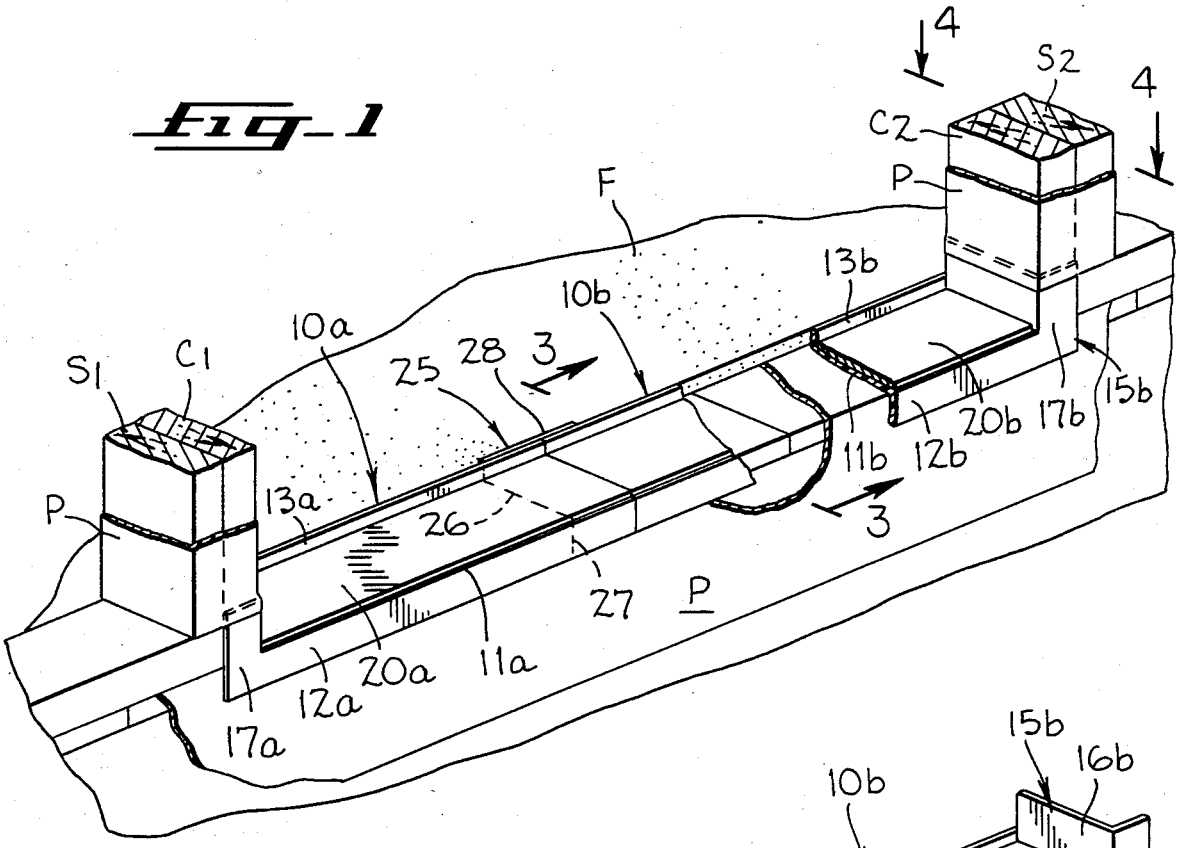
FIG. 1 is a fragmentary diagrammatic illustration of subflooring and a door frame shown with the sill of the door frame seated on moisture guards embodying the present invention.

Illustrated in FIG. 1 is a typical subflooring F. Fixed to the subflooring F are spaced cripples $C_1$ and $C_2$ of a door frame. Outboard of the cripples $C_1$ and $C_2$ and contiguous thereto are upright studs S. Paper flashing P is secured to the subflooring F in a conventional manner. Seated on the paper flashing P of the subflooring F and disposed between the cripples $C_1$ and $C_2$ in fixed relation thereto are moisture guards 10*a* and 10*b* embodying the present invention.

Figure 2:
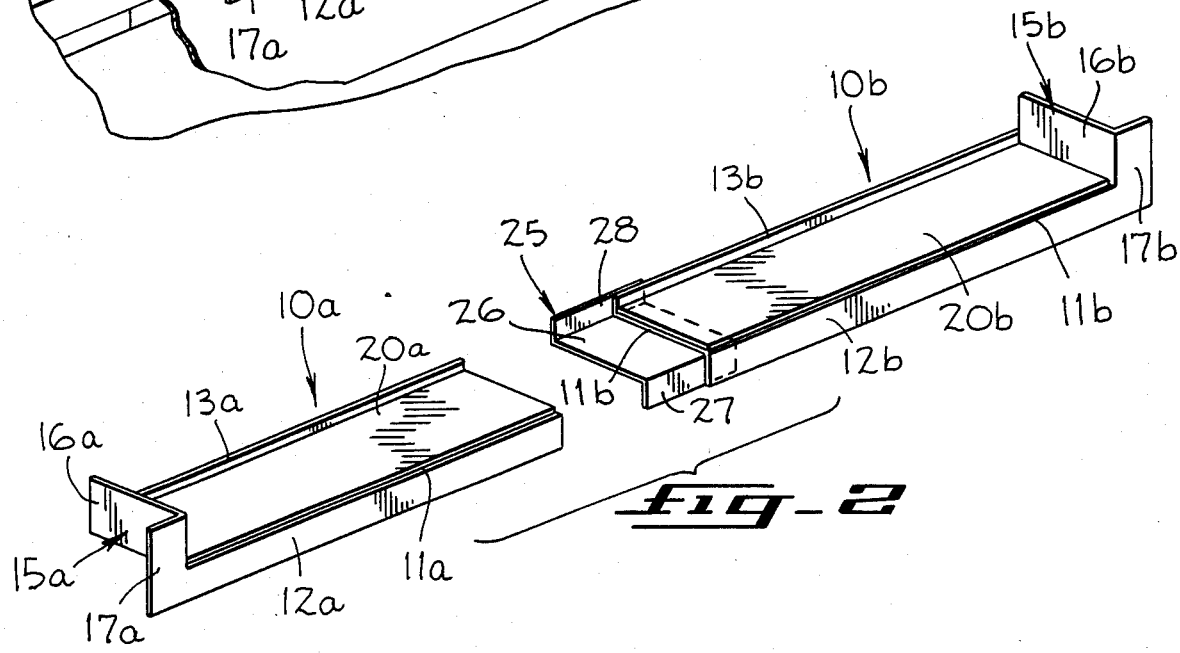
FIG. 2 is a perspective view of the moisture guards embodying the present invention in spaced relation.
Figure 3:
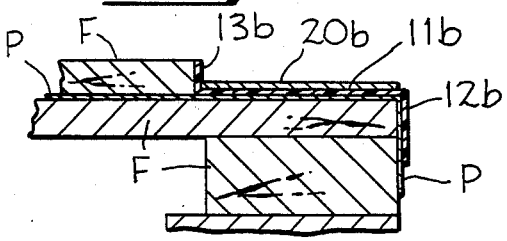
FIG. 3 is a vertical section view partially in elevation taken along line 3—3 of FIG. 1.
Figure 4:
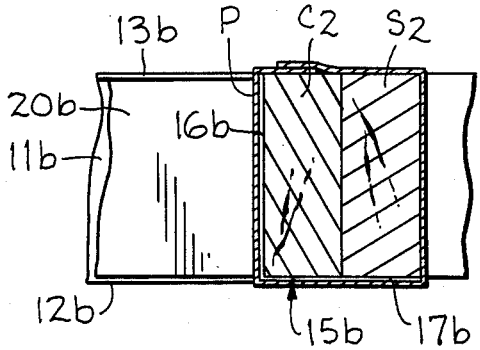
FIG. 4 is a vertical section view taken along line 4—4 of FIG. 1.

The moisture guard 10*a* (FIG. 2) comprises a horizontal base 11*a*. At the forward edge of the base 11*a* is an integrally formed depending front flange 12*a* that abuts against the paper flashing P along the vertical wall of the subflooring F. At the rearward edge of the base 11*a* is an integrally formed upstanding rear flange 13*a* that extends upwardly from the base 11*a* to provide a barrier to prevent moisture or water from seeping into the interior of a home or a building.

At one end of the base 11*a* of the moisture guard 10*a* is an integrally formed upstanding end flange 15*a* that embraces the adjacent cripple $C_1$. The end flange 15*a* has a vertical end wall 16*a* and vertical side wall 17*a*, which is at right angles to the vertical end wall 16*a*. The vertical side wall 17*a* extends upwardly to the height of the vertical end wall 16*a* and extends downwardly to the depth of the depending flange 12*a*.

Fixed to the base 11*a* of the moisture guard 10*a* is a metallic facing, such as a high grade aluminum plate 20*a*. The metallic facing 20*a* extends the entire length of the base 11*a* and substantially the entire width of the base 11*a*. In the preferred embodiment, the base 11*a*, the depending flange 12*a*, the upstanding flange 13*a*, and the end flange 15*a* constitute a unitary, one-piece construction and are made of a molded ABS plastic. The sill of a door frame or the sill of a window frame is installed on the metallic facing 20*a*.

The moisture guard 10*b* (FIG. 2) comprises a horizontal base 11*b*. At the forward edge of the base 11*b* is an integrally formed depending front flange 12*b* that abuts against the paper flashing P along the vertical wall of the subflooring F. At the rearward edge of the base 11*b* is an integrally formed upstanding rear flange 13*b* that extends upwardly from the base **11*b*** to provide a barrier to prevent moisture or water from seeping into the interior of a home or a building.

At one end of the base **11*b* of the moisture guard 10*b* is an integrally formed upstanding end flange 15*b* that embraces the adjacent cripple $C_2$. The end flange 15*b* has a vertical end wall 16*b* and vertical side wall 17*b*, which is at right angles to the vertical end wall 16*b*. The vertical side wall 17*b* extends upwardly to the height of the vertical end wall 16*b* and extends downwardly to the depth of the depending flange 12*b*.**

Fixed to the base **11*b* of the moisture guard 10*b* is a metallic facing, such as a high grade aluminum plate 20*b*. The metallic facing 20*b* extends along the length of the base 11*b* and substantially the entire width of the base 11*b*. In the preferred embodiment, the base 11*b*, the depending flange 12*b*, the upstanding flange 13*b* and the end flange 15*b* constitute a unitary, one-piece construction and are made of a molded ABS plastic. The sill of a door frame or the sill of a window frame is installed on the metallic facing 20*b*.**

The moisture guards **10*a* and 10*b* are disposed in end-to-end relation (FIG. 1) between the cripples $C_1$ and $C_2$ with the metallic facings 20*a* and 20*b* in abutting relation. An extension member 25 (FIG. 2) may be secured to the moisture guard 11*b* by an adhesive, such as A.B.S. cement. The extension member 25 comprises a base 26 that is secured to the base 11*b* therebelow, a depending flange 27 that is secured rearwardly of the depending flange 12*b*, and an upstanding flange 28 that is secured rearwardly of the upstanding flange 13*b*.**

The surfaces of the moisture guard **10*a* and the extension member 25 confront one another when the moisture guards 10*a* and 10*b* are placed in abutting relation and when the moisture guard 10*a* is disposed over the extension member 25 in overlapping relation. A suitable adhesive, such as A.B.S. cement, is applied. The moisture guards 10*a* and 10*b* and the extension member 25** are held together as a unitary structure when the adhesive is cured.

Now, the moisture guards **12*a* and 12*b* are placed on the paper flashing P of the subfloor F between the cripples $C_1$ and $C_2$. At this time, the end flange 15*a* is secured to the cripple $C_1$ by nails and the end flange 15*b* is secured to the cripple $C_2$ by nails. Paper flashing P is wrapped around the end flanges 15*a* and 15*b* and the associated cripples $C_1$ and $C_2$. Beads of caulking are deposited along the interior edges of the moisture guards 10*a* and 10*b* at the rear flanges 13*a* and 13*b*. The door frame is installed by disposing the sill thereof in the metallic facings 20*a* and 20*b* of the moisture guards 10*a* and 10*b*.**

A window frame is installed in a similar manner by positioning the moisture guards **10*a* and 10*b* on a typical threshold with the sill of the window frame placed on the metallic facings 20*a* and 20*b* of the moisture guards 10*a* and 10*b*.**

It is apparent that a single moisture guard may be used with end flanges at opposite ends thereof and with a single metallic facing extending from end-to-end.

We claim:

1. A moisture guard adaptable for seating on a threshold and on which a door frame, window frame or the like is installed to inhibit moisture from seeping into the interior of a building, which frame includes a sill and spaced upright members at opposite ends of the sill, said moisture guard comprising:

(a) a base adaptable for seating on the threshold and on which the sill of the frame is supported;

(b) a depending side flange at the front edge of said base for engaging the threshold;

(c) an upstanding side flange at the rear edge of the base for providing a barrier to inhibit moisture from seeping into the interior of the building; and (d) and end flange at an end edge of the base for engaging an upright member of the frame, said end flange comprising an upstanding end wall and a vertical side wall.

2. A moisture guard as claimed in claim 1 wherein said vertical side wall extends upwardly at right angles to said upstanding end wall and extends downwardly in planar relation to said depending side flange.

3. A moisture guard as claimed in claim 1 wherein said base, said depending side flange, said upstanding side flange and said end flange are integrally formed.

4. A moisture guard as claimed in claim 3 wherein said base, said depending side flange, said upstanding side flange and said end flange are made of plastic material.

5. A moisture guard as claimed in claim 4 and further comprising a metallic facing on said base on which the sill is supported for improved durability of the installation of the frame on the moisture guard.

6. A moisture guard assembly for seating on a threshold and on which a door frame, window frame or the like is installed to inhibit moisture from seeping into the interior of a building, which frame includes a sill and spaced upright members at the opposite ends of the sill, said moisture guard assembly comprising:

(a) juxtaposed bases adaptable for seating on the threshold and on which the sill of the frame is supported;

(b) juxtaposed depending side flanges at the front edges of said bases, respectively, for engaging the threshold;

(c) juxtaposed upstanding side flanges at the rear edges of said bases, respectively, for providing a moisture barrier to inhibit moisture from seeping into the interior of the building; and (d) end flanges at opposite end edges of said bases, respectively, for engaging a respective upright member of the frame, each of said end flanges comprising an upstanding end wall and a vertical side wall.

7. A moisture guard assembly as claimed in claim 6 and comprising a member for joining said bases, said depending side flanges, and said upstanding side flanges in juxtaposed relation.

8. A moisture guard assembly as claimed in claim 8 wherein said member comprises a base below said juxtaposed bases, a depending flange rearwardly of said juxtaposed depending side flanges and an upstanding flange rearwardly of said juxtaposed upstanding side flanges.

9. A moisture guard assembly as claimed in claim 6 wherein each of said vertical side walls extends upwardly at right angles to its associated upstanding end wall and extends downwardly in planar relation to the adjacent depending side flange.

10. A moisture guard assembly as claimed in claim 6 wherein associated bases, depending side flanges, upstanding side flanges and end flanges are integrally formed.

11. A moisture guard assembly as claimed in claim 10 wherein said associated bases, depending side flanges, upstanding side flanges and end flanges are made of plastic material.

12. A moisture guard assembly as claimed in claim 11 and further comprising a metallic facing on each of said bases on which the sill is supported for improved durability of the installation of the frame on the moisture guard assembly, said metallic facings being disposed in end-to-end relation.

13. A moisture guard assembly as claimed in claim 8 wherein each of said bases, said depending side flanges, said upstanding side flanges and said end flanges are made of plastic material.

14. A moisture guard assembly as claimed in claim 13 and further comprising a metallic facing for each of said juxtaposed bases on which the sill is supported for improved durability of the installation of the frame or the moisture guard assembly, said metallic facings being disposd in end-to-end relation.

* * * * *